United States Patent [19]

Belter

[11] 4,448,416

[45] May 15, 1984

[54] BALANCING GAME

[76] Inventor: Paul Belter, 335 Elwood Rd., East Northport, N.Y. 11731

[21] Appl. No.: 420,307

[22] Filed: Sep. 20, 1982

[51] Int. Cl.[3] ..... A63F 7/00

[52] U.S. Cl. ..... 273/110; 273/1 GF

[58] Field of Search ..... 273/110, 113, 115, 116, 273/1 G, 1 GE, 1 GF; 272/35

[56] References Cited

U.S. PATENT DOCUMENTS

| | | | |
|---|---|---|---|
| 1,661,864 | 3/1928 | Zabel | 272/35 |
| 2,517,324 | 8/1950 | Kurose | 273/110 X |
| 3,643,952 | 2/1972 | Sprowl | 273/110 |
| 3,675,920 | 7/1972 | Gorman | 273/1 GF |
| 4,070,025 | 1/1978 | Wiser | 273/110 |
| 4,310,156 | 1/1982 | Kulesza et al. | 273/1 GE |

FOREIGN PATENT DOCUMENTS

| | | | |
|---|---|---|---|
| 640361 | 12/1936 | Fed. Rep. of Germany | 273/110 |
| 1007226 | 4/1957 | Fed. Rep. of Germany | 273/110 |
| 806462 | 12/1936 | France | 273/110 |
| 20745 | of 1903 | United Kingdom | 273/110 |
| 410013 | 5/1934 | United Kingdom | 273/110 |

*Primary Examiner*—Richard C. Pinkham
*Assistant Examiner*—Scott Brown
*Attorney, Agent, or Firm*—Mark T. Basseches; Paula T. Basseches

[57] ABSTRACT

A balancing game includes a table continuously tilted in a variety of planes by a motorized drive. The player is provided with a control mechanism which, if skillfully employed, will retain the table surface in a horizontal plane against the actions of the motorized drive. A sphere placed on the table will roll off if the player is unable to maintain the table in a level or near level orientation.

10 Claims, 4 Drawing Figures

FIG. 1
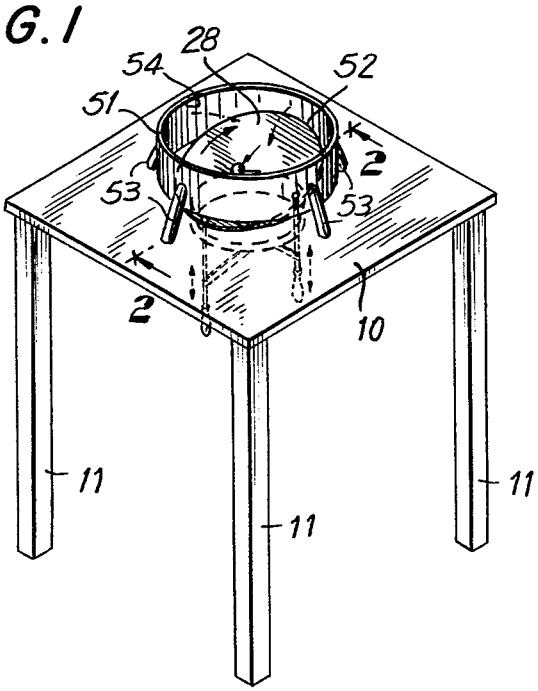
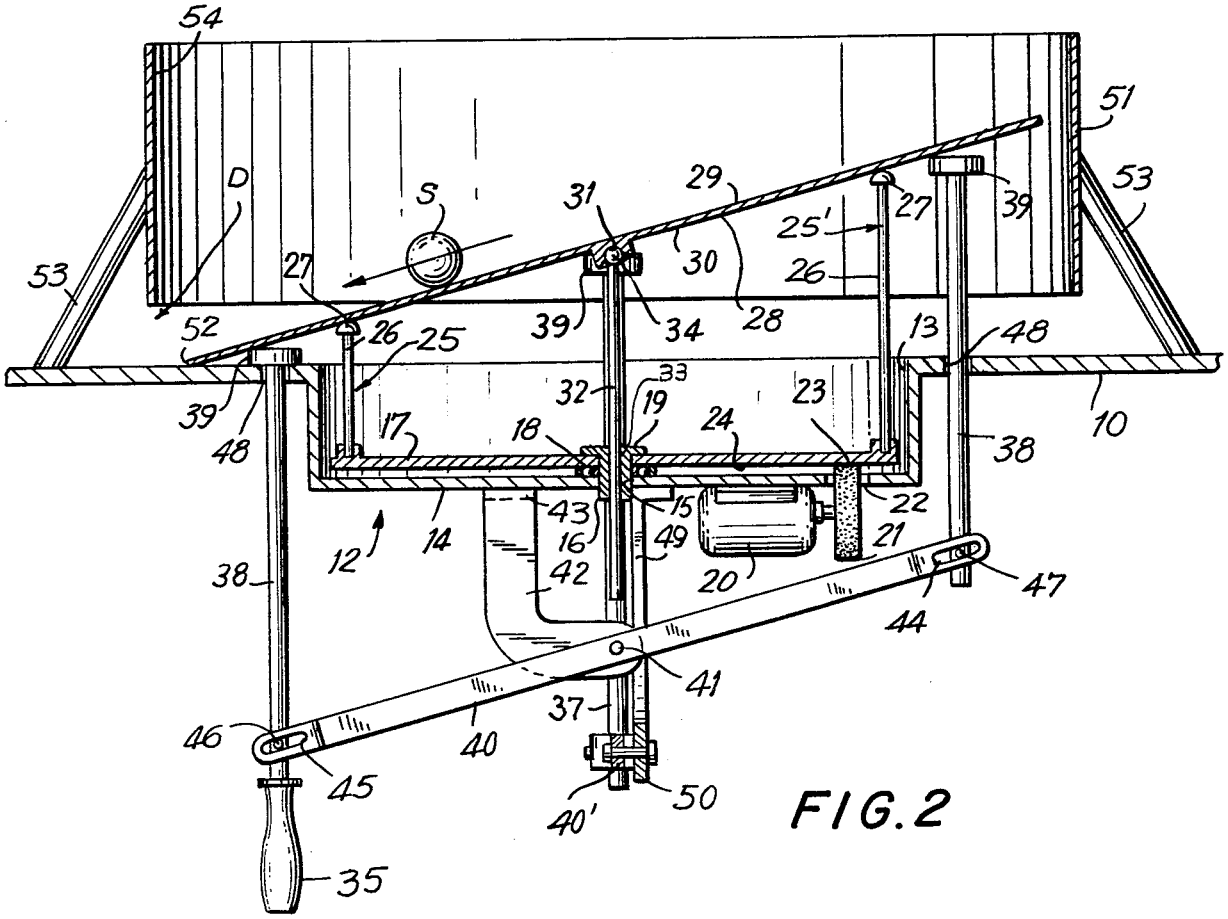
FIG. 2

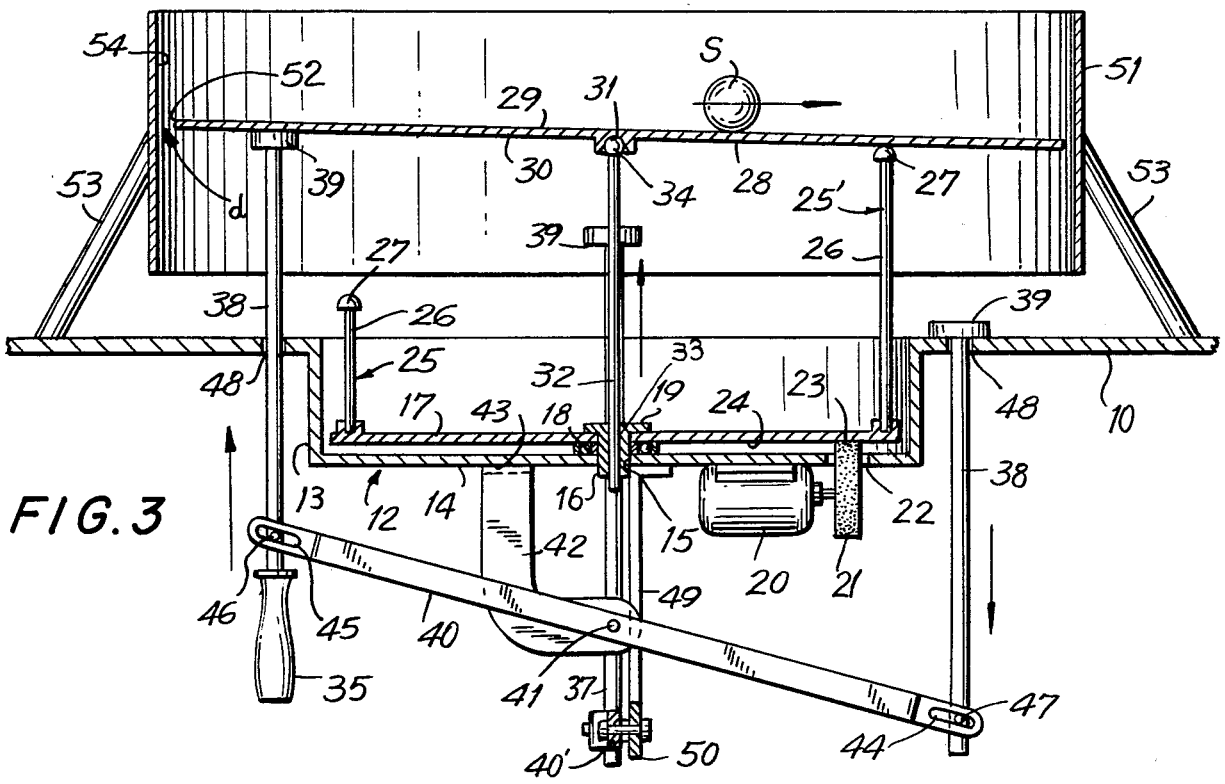
FIG. 3
FIG. 4
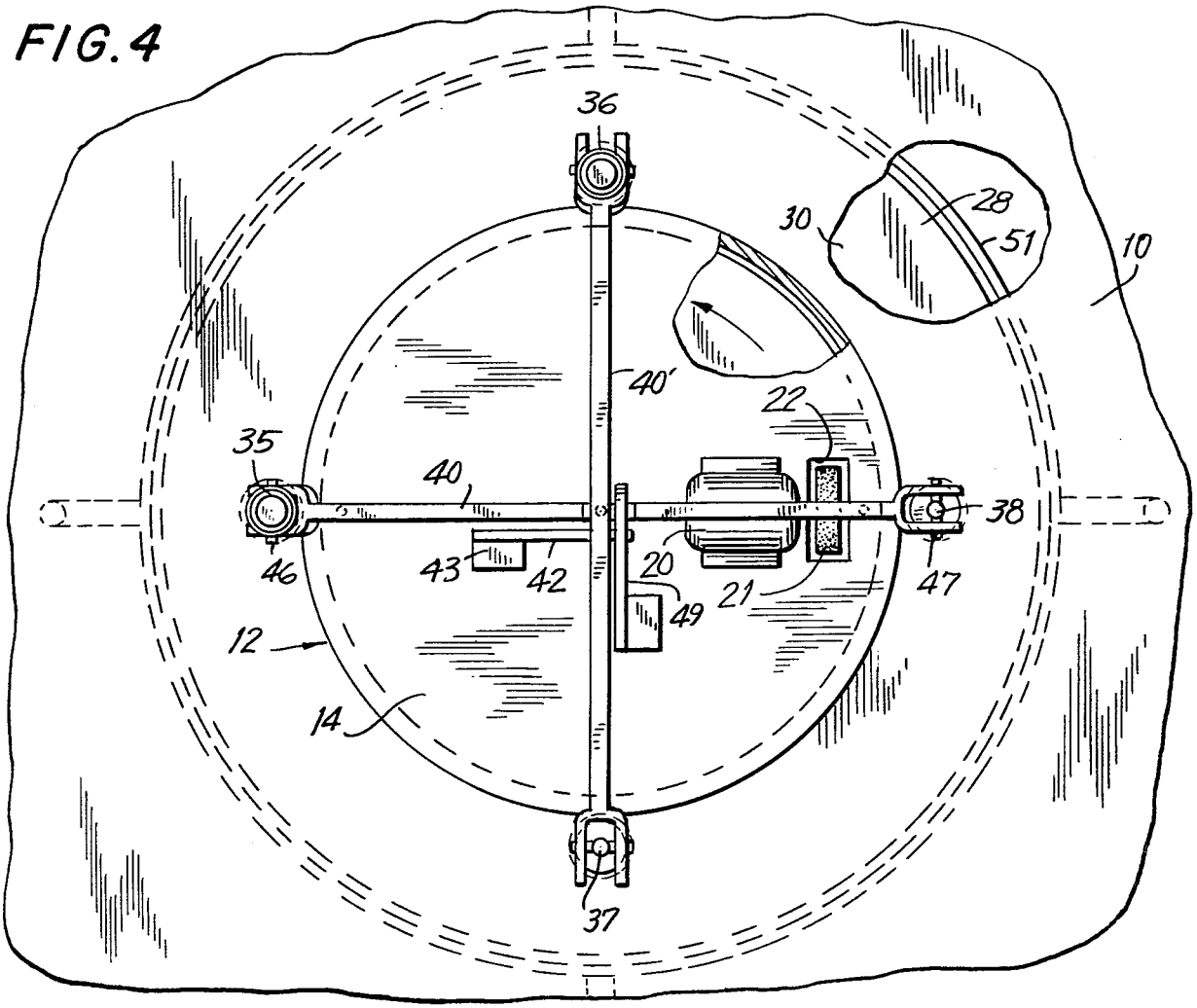

BALANCING GAME

BACKGROUND OF THE INVENTION

1. Field of the Invention

The present invention is in the field of the games of skill and pertains more particularly to a balancing game whereby a player is enabled to maintain a table which is subjected to continuous tilting influences in a level condition by the skillful operation of leveler members.

2. The Prior Art

Numerous game devices are known which test the skill of a player. In one form of game, a planar surface having a maze thereon is provided. The operator, by manipulation of controls, may induce tilting of the table in a variety of planes so as to guide a ball supported on the table through the maze in a path which avoids apertures in the game board through which the ball will drop if the board is not properly manipulated.

SUMMARY OF THE INVENTION

The present invention may be summarized as directed to a balance game of skill characterized in the provision of a table which is continuously caused to tilt from the horizontal by a motorized drive means. The player is provided with handles which must be continuously manipulated to counteract the tilting influences of the motorized means on the table in order to maintain a horizontal orientation of the table. A ball disposed on the surface of the table will roll off the table in the event that the player fails correctly to manipulate the leveler controls.

It is accordingly an object of the invention to provide a game of skill which includes a moving table and means enabling a player, through proper opertion of controls, to maintain the table at a horizontal orientation.

A further object of the invention is the provision of a game of the type described which is helpful in developing the eye-hand coordination of the player.

To attain these objects and such further objects as may appear herein or be hereinafter set forth, reference is made to the accompanying drawings, forming a part hereof, in which:

FIG. 1 is a perspective view of one form or embodiment of a game device in accordance with the invention;

FIG. 2 is a magnified vertical section taken on the line 2—2 of FIG. 1, showing the position of the board in a tilted orientation;

FIG. 3 is a view similar to FIG. 2 showing the position of the parts wherein the game table controls have been properly manipulated to maintain a substantially horizontal orientation of the table;

FIG. 4 is a bottom plan view of the apparatus.

Turning now to the drawings wherein there has been shown, by way of illustration and without limitation, a first form or emobidment of the invention, the game apparatus may comprise a base or frame member 10 supported by depending legs 11 on any support surface, such as a table or, when the game is made on a large scale, on a floor.

The base or frame 10 includes a recessed central cup or housing 12, including annular side walls 13 and a bottom wall 14. The bottom wall 14 is apertured, as at 15, within which aperture is fixedly mounted a bushing 16. A turntable 17, in the form of a disk, is rotatably mounted about the bushing 16, a ball bearing assembly 18 or like anti-friction member being interposed between the bottom wall 14 and the turntable 17. The upper end of the bushing 16 is shouldered as at 19 so as to restrain upward movement of the turntable relative to the bottom wall. From the foregoing description it will be apparent that the turntable 17 is free to rotate about the bushing but is fixed against veritcal movement.

A drive mechanism, illustratively motor 20, is secured to the under surface of the bottom wall 14. It will be readily recognized that the drive motor 20 may be of the wind-up spring type or an electric motor driven by a battery or from the mains supply. The motor 20, preferably operating through an internal speed reduction assembly, drives a friction puck 21.

The bottom wall 14 is provided with a clearance aperture 22 through which the upper peripheral portion 23 of the puck extends, enabling such peripheral portion to contact the under surface 24 of the turntable.

It will thus be appreciated that when the motor is energized, the turntable will be driven for rotation about a vertical axis coincident with the central axis of the bushing 16.

The turntable 17 carries a plurality of tilting means 25, 25' in the form of rods 26 having anti-friction knobs 27 at their uppermost end. Optionally the knobs may be comprised of nylon, Teflon or like slippery polymeric material. In the illustrated embodiment, four tilt means 25, 25' are provided, the tilt means being displaced at 90° intervals about the turntable. As will be apparent from FIGS. 2 and 3, for example, the opposed tilt means 25, 25', which are offset by 180°, are of differing vertical extent.

A tiltable table member 28 is provided having an upper surface 29 defining the playing surface. Table 28 includes centrally on its under surface 30 a downwardly directed parti-spherical cup or socket 31.

A shaft 32 is vertically shiftably mounted within a vertical aperture 33 formed in the bushing 16. The shaft 32 includes a ball member 34 at its upper end, the ball member being disposed within the socket 31 whereby it will be recognized that the table 29 is free to tilt from a horizontal orientation in an infinite number of planes about the radius of the ball 34.

As will be further perceived from the preceding description, when the turntable 17 is rotated, the weight of the table 28 (and the added eccentric weight of a ball or sphere as hereinafter described) will cause the same to rest on the upper edges of the anti-friction knobs 27 and, thus, as the turntable rotates supported on the knobs, the table 28 will progressively assume a continuously variable series of inclination from the horizontal in accordance with the rotated position of the turntable.

There will next be described the adjuster mechanism whereby a player, by appropriate and continuous manipulation, is enabled to counteract or compensate for the continuously changing tilting influence of the turntable on the table 28.

The adjuster mechanism is comprised of a pair of control handles 35, 36 which project below the frame or base plate 10 and control leveler members 37, 37, 38, 38 having lift portions 39, 39 at the upper ends thereof.

As will be appreciated from FIGS. 3 and 4, each of the control handles 35, 36 controls a pair of leveler members, the handle 35 controlling the leveler members 38 and the control handle 36 controlling the leveler members 37. Since each of the adjusted assemblies is essentially identical (each such assembly comprising a handle and a pair of lift members offset by 180°), a description of one will suffice.

The assembly controlled by handle 35 includes a cross link 40 pivotally mounted on a horizontal pivot pin 41 extending from L-shaped bracket 42, the upper end 43 of which is made fast to the bottom wall 14. The cross link 40 includes slot portions 44, 45 adjacent its ends. The leveler members 38 are coupled to the cross link 40 by pins 46, 47 projecting laterally from the levelers 38 and extending into the slots 45 and 44, respectively.

The base member 10 includes guide apertures 48, 48 within which the levers 38, 38 are guided for vertical sliding movement. It will thus be appreciated that when the control handle 35 is lifted or lowered one of the two levelers 38 will be lifted and the other will be lowered.

In similar fashion, the control handle 36 controls levelers 37, 37 disposed on the opposite ends of cross link 40', which cross link is mounted on the inturned portion 50 of L-shaped bracket 49 depending from the base plate 10.

Preferably an annular cowl or skirt 51 is fixedly secured above the base plate surrounding the outer periphery 52 of the table 28. The skirt 51 is secured by a series of standoffs 53 to the base plate 10, the inner face 54 of the skirt being spaced from the periphery 52 of the level table by a distance d (FIG. 3).

While there are numerous ways of playing and scoring the game, a preferred method involves manipulating the handles 35, 36 with the motor de-energized in such manner that the table is supported in a horizontal disposition. This orientation, which is illustrated in FIG. 3, occurs when the table is supported by the tallest of the anti-friction knobs 27 and when the levelers 37 opposite the tallest of the knobs are uppermost.

When in this orientation the motor is energized and a ball or sphere S, such as a marble or large ball bearing, is dropped on the upper or playing surface 29 of the table 28. As the turntable rotates, the plate will tilt progressively in an infinite variety of planes and it is the objective of the player to operate the handles 35, 36 so as to compensate for the tilting moments induced by the tilting influences of the knobs 27.

Preferably the plate is of relatively light weight material and the weight of the ball will thus accentuate the tendency of the plate to assume a tilted configuration against the various fixed and movable knobs and support mechanisms.

As will be apparent from an inspection of FIGS. 2 and 3, the handle 35 controls the transverse or side-to-side tilting of the plate as viewed in the orientation of the noted figures whereas the handle 36 controls the tilting of the plate in planes toward and away from the viewer.

Referring particularly to FIG. 3, it will be seen that the plate is maintained in an essentially horizontal orientation by the lefthand member 39 but when the turntable is rotated such that the lifter 25' underlies the lefthandmost side of the table, the leveler 39, which is lowermost in FIG. 3 will have to be raised to maintain the horizontal orientation.

As shown in FIG. 2, when the plate is inclined to the horizontal, the periphery 52 of the table 28 is spaced a distance D from the skirt, which is larger than the distance d, FIG. 3, the distance D being sufficiently large to permit the passage of the sphere S outwardly clear of its confines within the skirt 51. Thus, the player who permits the table to become sufficiently inclined to allow the sphere to escape "loses" the game.

Obviously a wide variety of rules may be adopted to enable the game to be played by a number of contestants. For instance, the time during which a player is able to maintain the sphere on the plate surface may be used as a criterion for winning a multi-player contest.

Various other scoring mechanisms may be adopted. For instance, the playing surface may include a series of scoring pockets, the objective in such case being to so manipulate the controls as to induce the sphere to fall into or to avoid specific such pockets.

As will be apparent to those skilled in the art and familiarized with the instant disclosure, numerous variations may be made in details of construction without departing from the spirit of the invention. Accordingly the same is to be broadly construed within the scope of the appended claims.

Having thus described the invention and illustrated its use, what is claimed as new and is desired to be secured by Letters Patent is:

1. A game of skill comprising a frame, a support member mounted on said frame for vertical movement relative thereto, a table carried on said support member, said table having a generally planar upper playing surface and an under surface, universal joint connection means interposed between a central portion of said table and said support member for tiltably supporting said playing surface for movement about the pivot axis of said connection in an infinite number of planes relative to the horizontal, rotary drive means on said frame beneath said table member, tilt means on said drive means slidably engaging said under surface of said table for tilting said table about said pivot axis in accordance with the rotated position of said drive means, at least two pairs of adjuster means mounted on said frame beneath said under surface of said table in angularly offset positions surrounding said support member, said adjuster means including leveler portions engaging said under surface of said table, said adjuster means being vertically shiftable, and a manual control means operatively connected to each pair of said adjuster means for varying the heightwise position of said leveler portions, thereby to enable counteracting of the tilting influence of said tilt means on said table.

2. Apparatus in accordance with claim 1 and including a spherical member disposed on said playing surface for indicating a tilted condition of said surface.

3. Apparatus in accordance with claim 1 wherein said adjuster means are spaced about said support member at angles offset by substantially 90°, the combination including linkage means connecting the members of each said pair, said linkage means functioning to lower one member of said pair and raise the other member of said pair responsive to movements of said manual control means.

4. Apparatus in accordance with claim 3 wherein the members of each said pair of adjuster means are offset by substantially 180°.

5. Apparatus in accordance with claim 1 wherein said drive means comprises a disk member rotated by a motor about an axis coincident with the axis of said support member, and said tilt means comprise strut members extending upwardly from said disk member.

6. Apparatus in accordance with claim 1 wherein said universal joint comprises a ball and socket connection.

7. Apparatus in accordance with claim 1 and including a skirt member on said frame in spaced surrounding relation to said table, a spherical member adpated to be supported on said playing surface in the level condition of said surface, the space between the skirt member and the outer periphery of said table being less than the diameter of said spherical member in the horizontal disposition of said table and greater than the diameter of said spherical member when said surface is displaced a predetermined angle to relative to the horizontal.

8. A game of skill comprising a frame, a table mounted on said frame for tilting movement about a pivot point, motorized drive means on said frame operatively connected to said table for continuously inducing tilting movements of said table about said point, and manually adjustable control means on said frame adapted to be shifted into operative connection with said table eccentrically of said point for counteracting the tilting effects of said drive means in accordance with the adjusted position of said control means.

9. A game in accordance with claim 8 wherein said motorized drive means includes lifter portions slidably engaging an under surface portion of said table and said control means comprise vertically shiftable leveler members angularly spaced about and adapted to be shifted into engagement with said under surface.

10. A game in accordance with claim 9 and including a sphere adapted to be supported on said upper surface when the same is horizontally disposed.

* * * * *